US006729441B1

(12) United States Patent
Nahlen

(10) Patent No.: US 6,729,441 B1
(45) Date of Patent: May 4, 2004

(54) EXTENSION LADDER SAFETY ADAPTER

(76) Inventor: Bernard F Nahlen, 1255 Pasado Rd., Marysville, CA (US) 95901

( * ) Notice: Subject to any disclaimer, the term of this patent is extended or adjusted under 35 U.S.C. 154(b) by 0 days.

(21) Appl. No.: 10/115,458

(22) Filed: Apr. 3, 2002

(51) Int. Cl.[7] ..... E06C 7/00
(52) U.S. Cl. ..... 182/206; 182/107
(58) Field of Search ..... 182/206, 107, 182/214

(56) References Cited

U.S. PATENT DOCUMENTS

| | | | | | |
|---|---|---|---|---|---|
| 3,715,012 | A | * | 2/1973 | Perry | 182/107 |
| 3,792,756 | A | * | 2/1974 | Kelly | 182/93 |
| 5,373,913 | A | * | 12/1994 | Santos | 182/107 |
| 6,354,400 | B1 | * | 3/2002 | Purkayastha | 182/107 |
| 6,405,828 | B1 | * | 6/2002 | Redding | 182/107 |

FOREIGN PATENT DOCUMENTS

FR 2567954 * 1/1986

* cited by examiner

*Primary Examiner*—Alvin Chin-Shue
(74) *Attorney, Agent, or Firm*—Michael I Kroll

(57) ABSTRACT

The present invention 10 discloses an extension ladder safety adapter that is fabricated from a single elongated strap 22 made of a sturdy, malleable material, preferably metal, wherein each distal end of the strap 22 forms a substantially rectangular side rail retention bracket 18 of a size and shape adequate to accommodate the insertion of an industry standard extension ladder side rail 12 therethrough. Separation of the side walls of the retention bracket 18 is prohibited by a fastening element 20 such as a pop rivet that fastens the foot 30 of each bracket 18 to the bearing strap 22. The retention brackets 18 are secured to the side rails 12 either by sheet metal screws that screw directly into the ladder side rails or by other appropriate non-penetrative pressure-securing means that may reduce damage perpetrated upon the ladder. A recess 24 is located in a central portion of the bearing strap 22 through which a fastening element 28 such as a nail or a screw may be placed and imbedded into the supporting object 16 to prevent the ladder from sliding and possibly falling. Furthermore, a textured, arcuate, self-centering pad 26 having a non-skid surface may be included on the supporting side of the bearing strap 22 to provide additional stability.

3 Claims, 7 Drawing Sheets

EXTENSION LADDER SAFETY ADAPTER

BACKGROUND OF THE INVENTION

1. Field of the Invention

The present invention relates generally to ladder retaining devices and, more specifically, to a ladder retaining device for extension ladders and other like ladders having side rails that extend beyond the top rung and is used to prevent the ladder from sliding and possibly falling when placed against a narrow, substantially cylindrical object such as a tree or a utility pole. When used for such applications, the top rung of the ladder is usually placed against a tree or pole with the straight rung having limited bearing surface contacting the curved surface of the object being climbed and often requires the person climbing the ladder to perform a balancing act to prevent the center of gravity from shifting to one side and creating a potentially hazardous situation.

The present invention seeks to overcome the shortcomings of the prior art by providing an extension ladder safety adapter that is fabricated from a single elongate plate of a sturdy, malleable material, preferably metal, wherein each distal end of the plate forms a substantially rectangular side rail retention bracket of a size and shape adequate to accommodate the insertion of an industry standard extension ladder side rail therethrough. Separation of the side walls of the retention bracket is prohibited by a fastening element such as a pop rivet that fastens the foot of each bracket to the bearing plate. The retention brackets are secured to the side rails either by sheet metal screws that screw directly into the ladder or by other appropriate non-penetrative pressure-securing means that may reduce damage perpetrated upon the ladder.

Once the present invention is installed and secured to the ladder it is ready for use. The extension ladder safety adapter will not obstruct the use of the ladder during conventional applications such as being placed against the flat wall of a building. When used with a tree or pole the bearing strap is placed thereagainst rather than the top ladder rung as is conventionally done. The weight of the ladder and pressure applied thereto by the user cause the bearing strap to deform to a curvature somewhat similar to that of the object supporting the ladder to create a greater bearing surface. A recess 24 is located in a central portion of the bearing strap 22 through which a fastening element 20 such as a nail or a screw may be placed and imbedded into the supporting structure to prevent the ladder from sliding and possibly falling. Furthermore, a textured, arcuate, self-centering pad 26 having a non-skid surface may be included on the supporting side of the bearing strap 22 to provide additional stability, particularly until the user climbs the ladder to install the fastening element to secure the present invention and the attached ladder to the object being climbed.

The present invention will provide a user with increased safety when using an extension ladder placed against a pole, tree or other such object by providing a ladder safety adapter comprising a malleable bearing strap having side rail retention brackets on the distal ends thereof that could be removably fastened to the side tails above the uppermost rung of an extension ladder.

2. Description of the Prior Art

There are other ladder stabilizing devices known in the art. While these ladder stabilizing devices may be suitable for the purposes for which they were designed, they would not be as suitable for the purposes of the present invention, as hereinafter described.

SUMMARY OF THE PRESENT INVENTION

The present invention discloses an extension ladder safety adapter that is fabricated from a single elongated strap made of a sturdy, malleable material, preferably metal, wherein each distal end of the strap forms a substantially rectangular side rail retention bracket of a size and shape adequate to accommodate the insertion of an industry standard extension ladder side rail therethrough. Separation of the side walls of the retention bracket is prohibited by a fastening element such as a pop rivet that fastens the foot of each bracket to the bearing strap. The retention brackets are secured to the side rails either by sheet metal screws that screw directly into the ladder side rails or by other appropriate nonpenetrative pressure-securing means that may reduce damage perpetrated upon the ladder. A recess is located in a central portion of the bearing strap through which a fastening element such as a nail or a screw may be placed and imbedded into the supporting object to prevent the ladder from sliding and possibly falling. Furthermore, a textured, arcuate, self-centering pad having a non-skid surface may be included on the supporting side of the bearing strap to provide additional stability.

A primary object of the present invention is to provide an extension ladder safety adapter that will enhance the stability of an extension ladder when placed against an object that is narrower than the distance between the side rails of said ladder.

Another object of the present invention is to provide an extension ladder safety adapter that provides a bearing plate that is removably affixed to the ladder side rails and is deformable in order to substantially conform to the object against which it is placed.

One other object of the present invention is to provide an extension ladder safety adapter that will prohibit the shifting and slipping of the ladder under conditions that would otherwise disturb the center of gravity of said ladder.

Yet another object of the present invention is to provide an extension ladder safety adapter having a means for releasably nailing or screwing the bearing strap to the support structure to temporarily secure said ladder thereto.

Another object of the present invention is to provide an extension ladder safety adapter wherein the support side of the bearing strap has a flexible, textured pad to provide a self-centering non-skid pad that also conforms to the curvature of the object being climbed to further enhance the bearing area of the support strap.

Yet another object of the present invention is to provide an extension ladder safety adapter simple and easy to use.

Additional objects of the present invention will appear as the description proceeds.

The present invention overcomes the shortcomings of the prior art by providing a malleable extension ladder safety adapter that conforms substantially to the contour of the support structure.

To the accomplishment of the above and related objects, this invention may be embodied in the form illustrated in the accompanying drawings, attention being called to the fact, however, that the drawings are illustrative only, and that changes may be made in the specific construction illustrated and described within the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
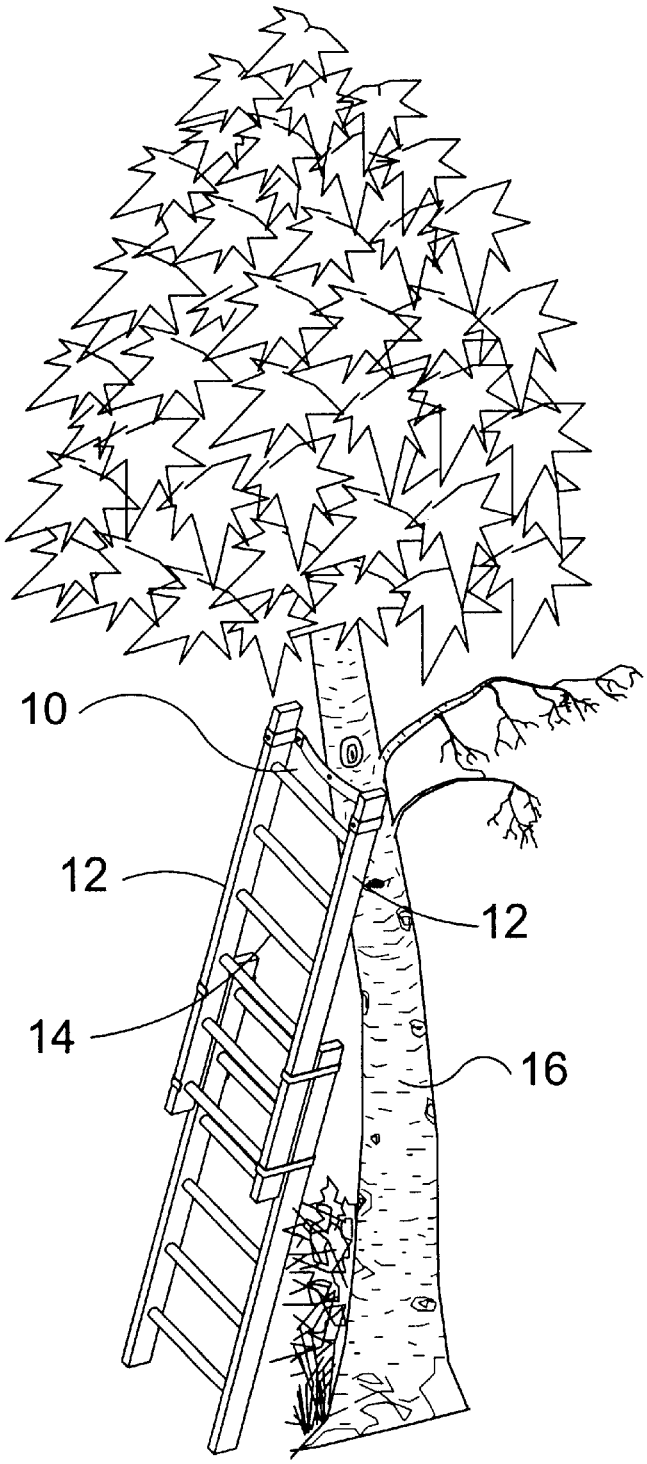
FIG. 1 is an illustrative view of the present invention in use.

With regard to reference numerals used, the following numbering is used throughout the drawings.

10 present invention

12 side rails

14 ladder

16 object

18 retention bracket

20 fastener

22 bearing strap

24 aperture

26 pad

28 central fastener

30 foot

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustration of the present invention 10 in use. It is a strap-like structure that fits over the side rails 12 of a ladder 14 and rests against the object 16 being climbed. It is particularly used when climbing a round object such as a tree or a pole. By way of general explanation which will be explained in greater detail hereinafter, the present invention 10 is secured to each of the ladder side rails 12 with one fastener each. This fastener passes through a clearance hole on the strap section of the loop ends and then screws into the ladder side rails 12. The present invention 10 may also be attached to the object 16 being climbed with a fastener which passes through the center area of the strap structure and into the structure being climbed.

Figure 2:
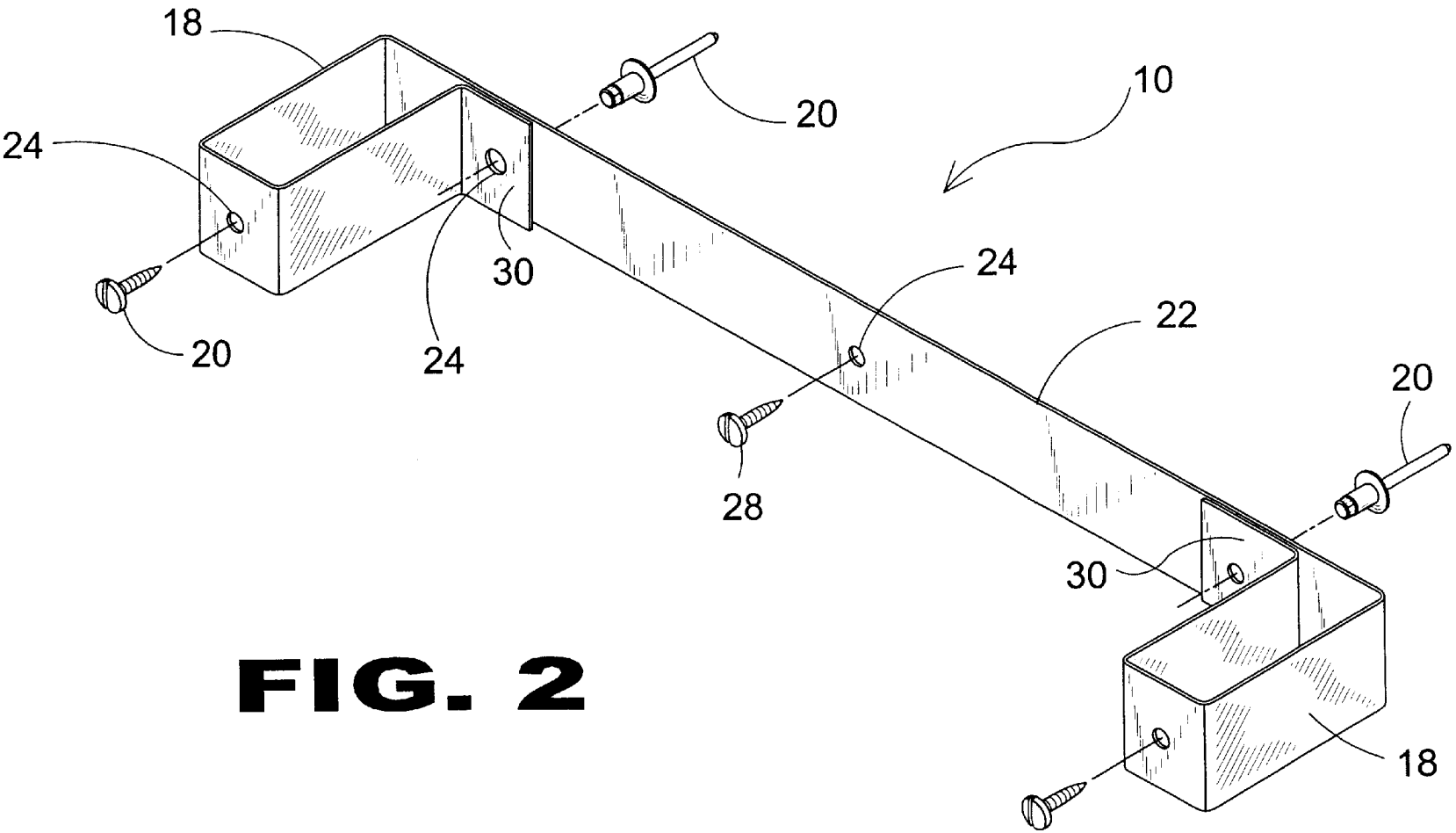
FIG. 2 is an exploded perspective view of the present invention.

Turning to FIG. 2, shown therein is a perspective view of the present invention 10. The extension ladder safety adapter 10 is expected to be made of sheet metal or the like having retention brackets 18 generally formed to fit around the side rails of most ladders. Once the ladder side rail retention bracket 18 is formed, the foot 30 of each ladder retention bracket is held to the bearing strap 22 by a fastener 20 passing through the aperture 24 to prevent the brackets 18 from elongating. A pop rivet may be used. The retention brackets 18 are formed at each end of a single, elongated bearing strap 22 or plate. An aperture 24 and fastener 20 for connection to the ladder side rail are provided in each retention bracket 18 and intermediate the bearing strap 22 at 28.

Figure 3:
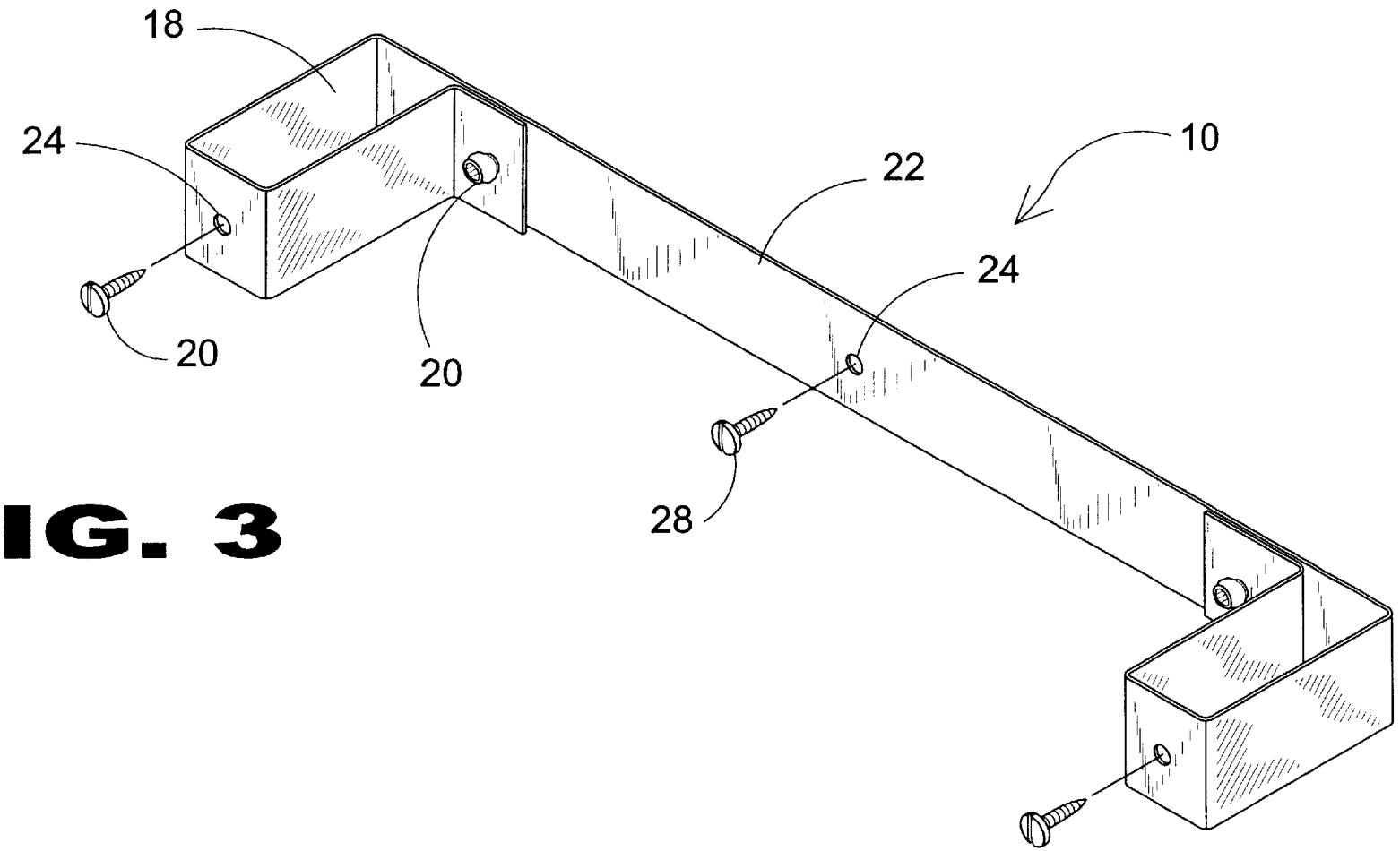
FIG. 3 is a perspective view of the present invention.

Turning to FIG. 3, shown therein is a perspective view of the present invention 10. The extension ladder safety adapter 10 is formed, the brackets 18 are handheld in position and fasteners 20 are placed through pre-drilled recesses 24. This prevents the ladder retention brackets 18 from elongating. A pop rivet type fastener 20 is generally used. Bearing strap 22 is also shown. Central fastener 28 is also shown.

Figure 4:
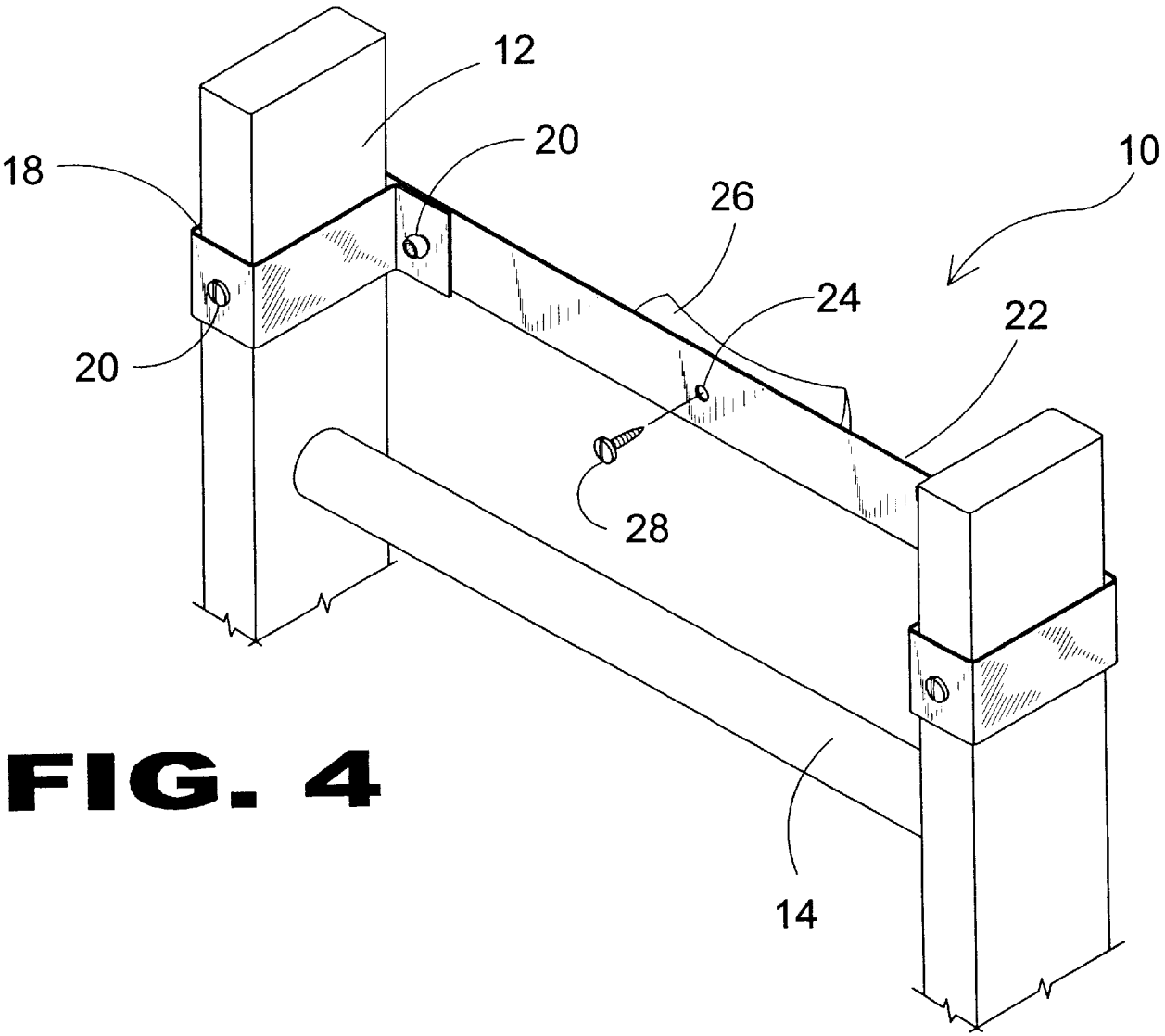
FIG. 4 is a perspective view of the present invention installed on a ladder.

Turning to FIG. 4, shown therein is a perspective view of the present invention 10 installed on a ladder 14 once the ladder retention brackets 18 are formed and the fasteners 20 attached, additional fasteners 20 are used to attach the extension safety adapter to the ladder side rails 12. These fasteners pass through pre-drilled recesses in each end of the loop or bracket 18 and partially penetrate the ladder side rails 12. A screw 20 is typically used. This prevents the safety adapter 10 from shifting position with respect to the ladder 14. A central fastener 28 is also positioned centrally on the bearing strap 22 which has a self-centering non-skid pad 26 disposed thereon.

Figure 5:
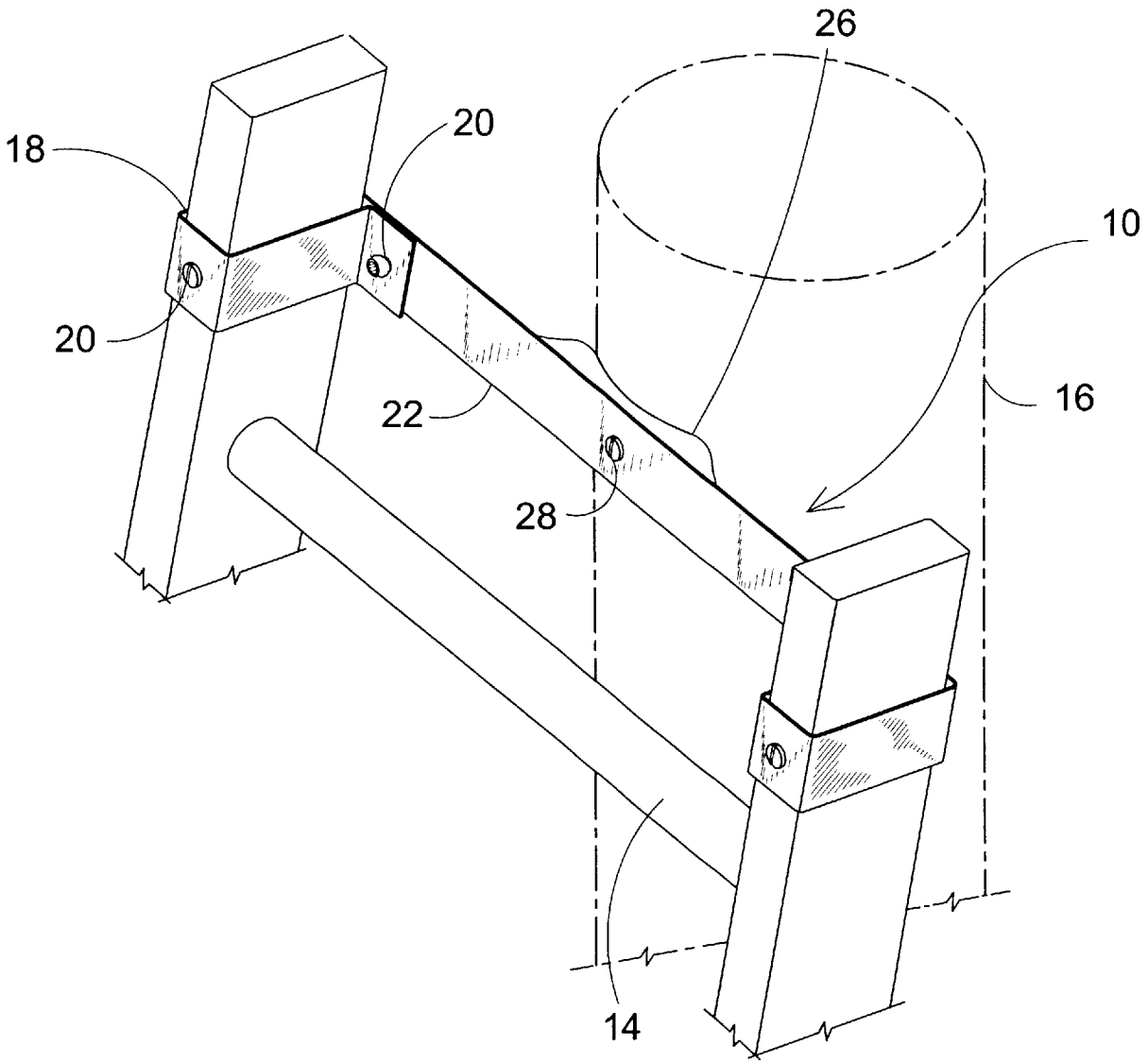
FIG. 5 is a perspective view of the present invention installed on a ladder and fastened to a utility pole.

Turning to FIG. 5, shown therein is a perspective view of the present invention 10 installed on a ladder 14 and secured to an object 16, i.e. a utility pole. Once the safety adapter 10 is attached to the ladder 14 via fasteners 20, an additional central fastener 28 is used to secure it to the structure 16 being climbed. This additional fastener 28 passes through a clearance hole 24 in the center area of the bearing strap 22 and is secured to the object 16 being climbed. Most commonly, a screw 28 is used to attach to a wooden structure, such as a tree or a pole. Also shown is the retention brackets 18 and non-skid pad 26.

Figure 6:
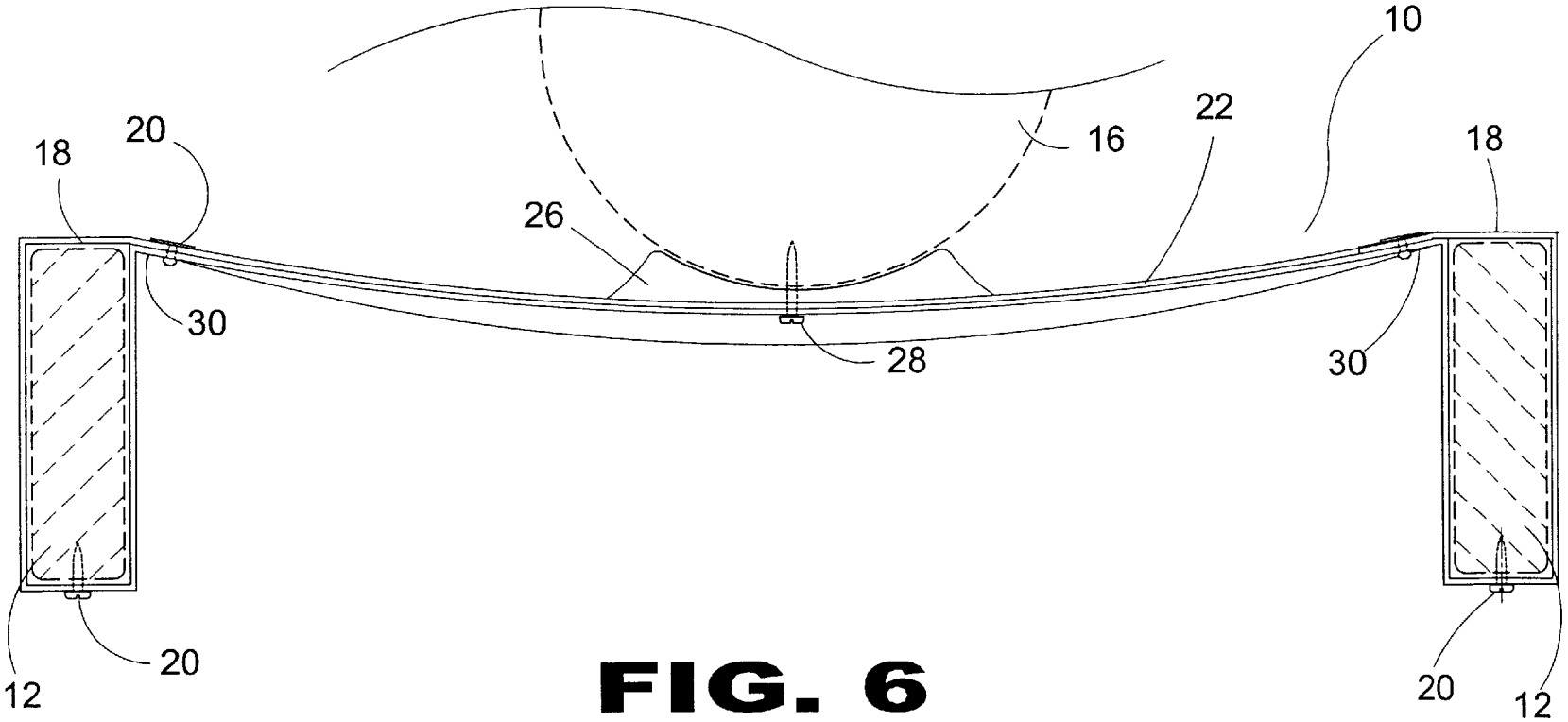
FIG. 6 is a top view of the present invention in use and fastened to a utility pole.

Turning to FIG. 6, shown therein is a top view of the extension ladder safety adapter 10 which is generally made of a malleable material, such as sheet metal and is generally formed to fit around the side rails 12 of most ladders. Once the strap 22 is formed into a loop or bracket like structure 18, fasteners 20 through foot 30 are used to prevent the loops from elongating. Additional fasteners 20 are also used to secure the extension ladder safety adapter in position with respect to the ladder side rails 12. Another central fastener 28 is used to secure the present invention 10 to the object 16 being climbed. Furthermore, a self-centering non-skid pad 26 is installed on the bearing strap 22 and conforms to the shape of the object 16 being climbed to prevent the strap 22 from sliding along the pole 16 until the fastening screw 28 is inserted through the strap and into the pole.

Figure 7:
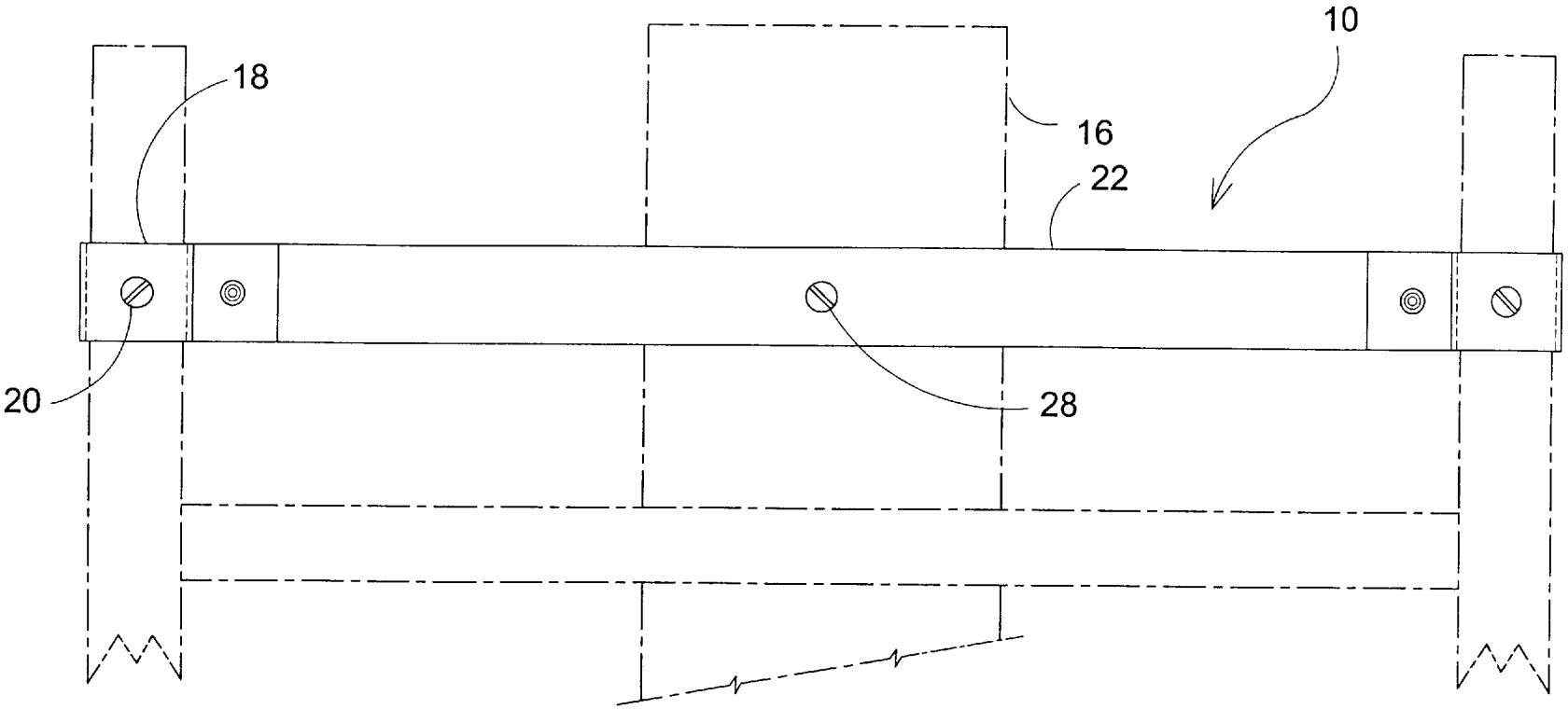
FIG. 7 is a front view of the present invention in use.

Turning to FIG. 7, shown therein is a front view of the present invention 10 showing a side view of the extension ladder safety adapter which is made of material such as sheet metal. Once the present invention 10 is formed into the ladder retention brackets 18 and the fasteners 20 are attached to the ladder side rails, the safety adapter 10 is still somewhat flexible, which helps it to somewhat conform to the object 16 being climbed. This is due to the flexible nature of the sheet metal of the strap 22 when it is in the "in use" position wherein it will flex around the object 16 being climbed, which adds to its stabilization. A central fastener 28, e.g. a screw, is used to secure it to the object 16 being climbed.

What is claimed to be new and desired to be protected by Letters Patent is set forth in the appended claims:

I claim:

1. An apparatus for providing a safety member above the top rung of a conventional ladder, the ladder having a plurality of rungs disposed between a pair of side rails, the safety member for being placed against an object, consisting of:

a) an elongated, flexible bearing strap, said strap having a first and second end;

b) a retention bracket formed on each of said first and second ends, each bracket extending around a side rail and terminating in a foot resting against an inner surface of said strap between said side rails;

c) a first pair of fasteners for connection of said retention brackets to the side rails;

d) a second pair of fasteners, one through each foot for connection of each foot of said bracket to said strap;

e) a self-centering non-skid pad mounted on an outer surface of said strap, located centrally between said side rails and having a concave surface for resting, against said object;

f) a central fastener passing through a central aperture of said strap through said pad into the object against which the ladder is placed to permit attachment of said strap to the object, a surface of said pad adapted to be in contact with said object having being a none skid surface.

2. The apparatus of claim 1, wherein said fasteners further comprise screws.

3. The apparatus of claim 1, wherein said retention brackets are rectangular.

* * * * *